United States Patent [19]

Cohen

[11] Patent Number: 4,484,673

[45] Date of Patent: Nov. 27, 1984

[54] COIN DIVERTER

[75] Inventor: M. Roy Cohen, Warren, Vt.

[73] Assignee: Solon Automated Services, Inc., Washington, D.C.

[21] Appl. No.: 429,465

[22] Filed: Sep. 30, 1982

[51] Int. Cl.[3] ..... G07F 5/06

[52] U.S. Cl. ..... 194/1 G; 194/1 H

[58] Field of Search ..... 194/1 H, 1 B, 1 C, DIG. 10, 194/1 G, DIG. 1, DIG. 2, 92, 93, 1 E; 232/12, 15; 133/3 E, 3 H

[56] References Cited

U.S. PATENT DOCUMENTS

| | | | |
|---|---|---|---|
| 1,380,929 | 6/1921 | Ruebsamen . | |
| 1,765,014 | 6/1930 | Hochriem . | |
| 3,239,737 | 3/1966 | Griesmer et al. . | |
| 3,333,764 | 8/1967 | Pennell | 232/15 |
| 3,339,835 | 9/1967 | Itman | 232/1 |
| 4,156,501 | 5/1979 | Greenwald et al. | 232/1 |
| 4,221,285 | 9/1980 | Greenwald et al. | 194/1 G |

*Primary Examiner*—Stanley H. Tollberg

*Attorney, Agent, or Firm*—Banner, Birch, McKie & Beckett

[57] ABSTRACT

A coin diverting mechanism for dividing the proceeds of coin operated machines into two separately and uniquely lockable coin receiving boxes. The proceeds are divided automatically according to any agreed upon business arrangement by the positioning of coins slots on the coin slide. When the machine is activated, the agreed percentage share of coins is deposited directly into each of the coin receiving boxes.

7 Claims, 6 Drawing Figures

COIN DIVERTER

BACKGROUND OF THE INVENTION

1. Field of the Invention

This invention relates generally to deposit and collection receptacles for coin operated machines. The invention comprises a coin diverting mechanism for diverting a specified percentage of coins inserted into the coin operated machine into one of at least two coin receiving boxes. Each of the coin receiving boxes is individually and uniquely secured to the coin operated machine.

2. Description of the Prior Art

In an arrangement common throughout the vending machine industry, the owner of a vending machine shares the proceeds of the machine with the owner of the space which the machine occupies when it is placed in use. However, most machines have only a single coin receiving box. This requires, therefore, that the money received in the box be counted and then divided according to the agreed arrangement between the owner of the machine and the owner of the space. Unless both owners, or representatives of both owners, are present when the coin box is removed and the proceeds are counted, the owner not present or represented is not able to determine if an accurate accounting of the proceeds is made and if the proceeds were divided according to the agreed upon arrangement.

It is well-known to use a lockable coin box to receive the proceeds of a coin operated machine. Lockable coin receiving boxes may be located either within the coin operated machine or may be included in a housing mounted on the coin operating machine. Various coin inserting mechanisms, such as the coin slides disclosed in U.S. Pat. No. 4,221,285, are also well-known in the art for activating the coin operated machine.

It is also known to use two coin boxes to divide the proceeds of money inserted into a coin operated machine. In Pennell, U.S. Pat. No. 3,333,764, a coin diverter in the operating mechanism of the machine divides coins between one of two coin receiving boxes. The diverter, disclosed as a channel, automatically divides the proceeds according to a specified percentage arrangement and directs each share of the proceeds into a separate box. The coin diverting mechanism, however, is merely an incidental part of the Pennell disclosure, which is directed primarily to a locking mechanism for one of the coin receiving boxes. Therefore, Pennell neither discloses nor illustrates the construction of the diversion channel, the way in which coins travel from the coin side through the diversion channel, and the way in which the coins are divided to fall into one of the two coin boxes. Pennell also does not disclose the construction or placement of the second coin box, but merely suggests that one exists.

Based upon the cursory description of a coin diverter in Pennel, a separate channel is required between the coin inserting mechanism and each of the coin boxes. This channel, in some undisclosed fashion, divides the coins according to a predetermined agreement. A separate channel is required to each coin box, which adds both size and expense to the coin actuating and collecting mechanism. A complex, separate coin diverting channel is not needed in the invention described and claimed herein. The Pennel disclosure does not provide for a diversion of proceeds other than 50/50. With the instant invention, any percentage allocation may be achieved readily and simply.

Hochriem, U.S. Pat. No. 1,765,014, discloses a complex arrangement of counterweights and lever arms for dividing coins according to a predetermined ratio and placing each share in a separate, lockable coin box. Hochriem requires a separate coin diverting mechanism for each denomination of coin. Thus, if only quarters were used, one diverter and two coin boxes would be required. If both quarters and dimes were used, two diverters and four coin boxes would be required.

It is also known to use diverters which operate to fill, in sequence, more than one coin box, as shown in U.S. Pat. No. 1,380,929. Coin sorters which automatically divide coins according to their denomination into separate coin boxes also are well known, as exemplified by U.S. Pat. No. 3,239,737.

The prior art does not disclose, however, a coin diverting mechanism for dividing the proceeds of a coin operated machine which functions simply and efficiently and is modified easily to effect any desired division of proceeds. In the preferred embodiment, the instant invention uses a coin slide to automatically divide the proceeds into separate, individually lockable coin boxes without the need for any additional diverting channels or other diverting mechanisms.

SUMMARY OF THE INVENTION

The problem of accountability and accuracy in dividing proceeds of a coin operated machine can be eliminated by providing two coin receiving boxes. Each coin receiving box receives an agreed upon share of the proceeds of the machine. Each coin receiving box is individually and uniquely lockable, with each owner have a key to the box which receives his share of the proceeds.

This invention provides a simple mechanism for easily and accurately dividing the proceeds of a coin operated machine according to a prearranged formula. In the preferred embodiment, coins are inserted into the machine by a coin slide, such as is typically used on commercial washing machines or dryers. The coin slide has a particular arrangement of coin slots. The slots are arranged in two rows in the preferred embodiment, where the division of proceeds is to be made between two people. It is to be understood that this invention could also be practiced where the division of proceeds is to be made between more than two people. In such instances, the number of rows of coin slots on the coin slide would correspond to the number of coin receiving boxes. One coin receiving box would be provided for each person among whom the proceeds would be divided.

The number and denomination of coins in each row of the coin slot determines the specified division of the proceeds. For example, if a coin operated machine required one dollar to activate the machine and the proceeds were to be divided evenly between two people, the coin slide would have two rows with each row having two quarter slots. If the division of proceeds between two people was to be 75/25, the coin slide would again have two rows of coin slots but in this instance one row would have slots for three quarters and the second row would have a single slot for one quarter. If the division of proceeds between two people was to be 60/40, one row of coin slots on the coin slide would have slots for two quarters and one dime, while the other row would have coin slots for one quarter, one dime and one nickel. It is thus evident, that by choosing the number and denomination of coin slots in the rows, any agreed upon division of proceeds may be obtained.

In a conventional arrangement, the coin slide and the coin receiving box are contained within a housing mounted on the washer or the dryer. Typically, the coin box is located below the coin slide. When coins are present in the slots of the coin slide and the slide is pushed into the housing, the machine is activated and the coins are permitted to drop through the slots into the coin box. The present invention provides an individual coin receiving box below each row of coins. Each box is individually lockable within the housing attached to the machine. As the machine is used, the coins are automatically deposited according to the agreed percentage allocation into each of the coin receiving boxes. Each owner is thus assured that the agreed percentage share of the proceeds is being followed. Each owner also has individual access to the coin receiving box which receives his share of the proceeds. Thus, each owner may collect his share of the proceeds as often or whenever he would like to collect them without the need to prearrange for each of the owners to be present.

Thus it will be seen that this invention provides an improved and simplified method for dividing the proceeds of coin activated machines.

DETAILED DESCRIPTION OF THE PREFERRED EMBODIMENT

Figure 1:
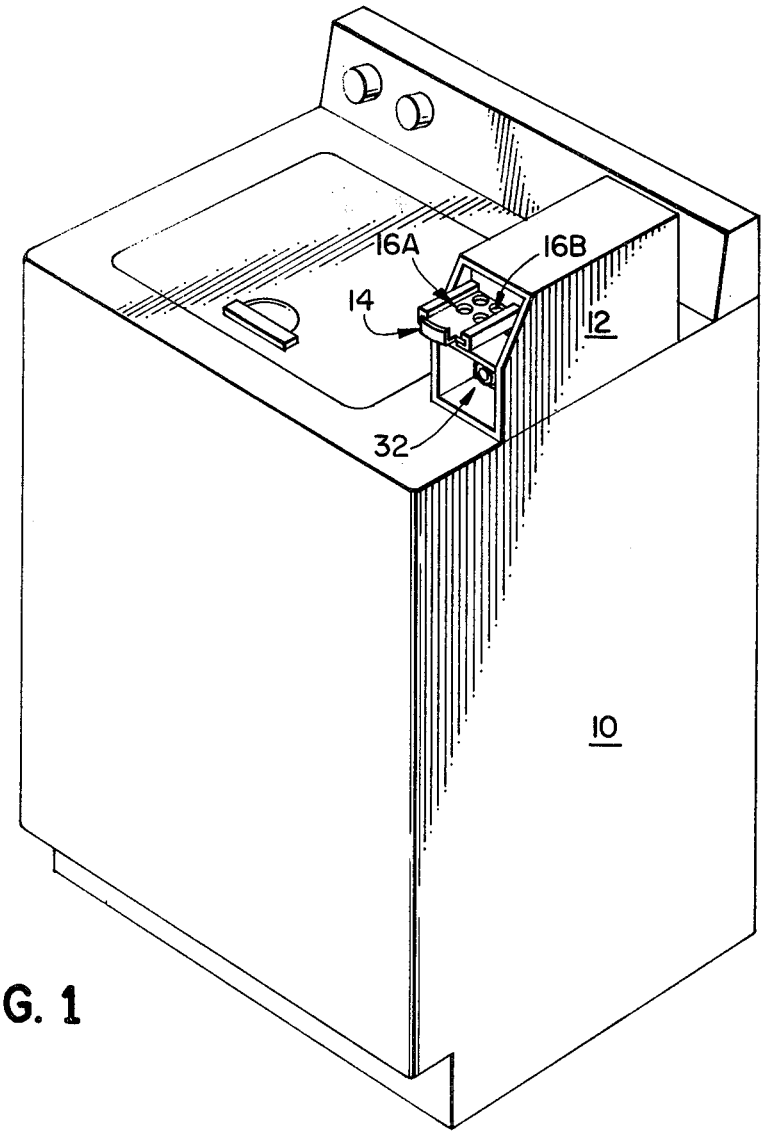
FIG. 1 is a perspective view of a coin operated machine equipped with the coin diverter of the instant invention.
Figure 2:
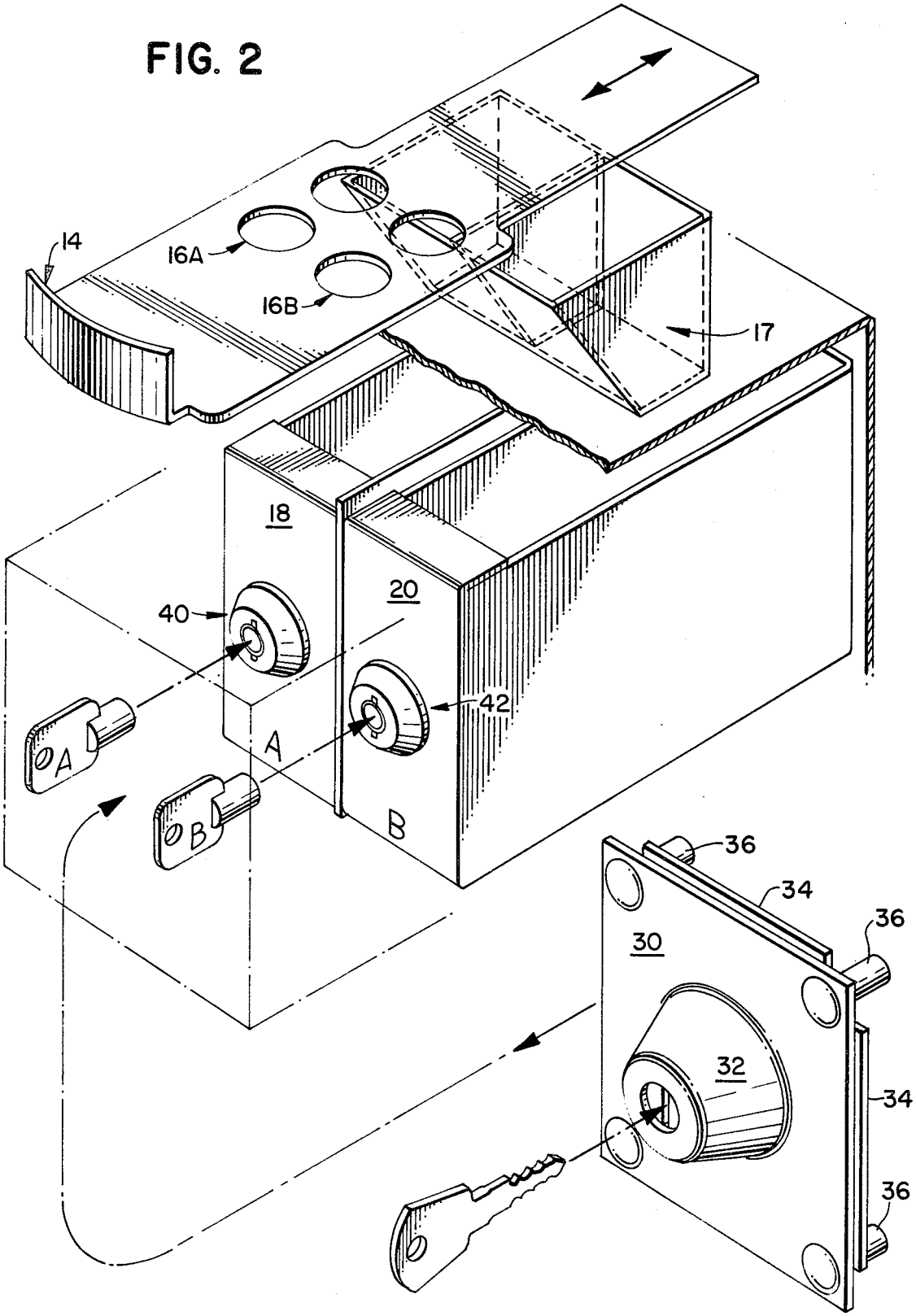
FIG. 2 is an exploded view of the principal parts cooperating in the coin diverting mechanism.
Figure 3:
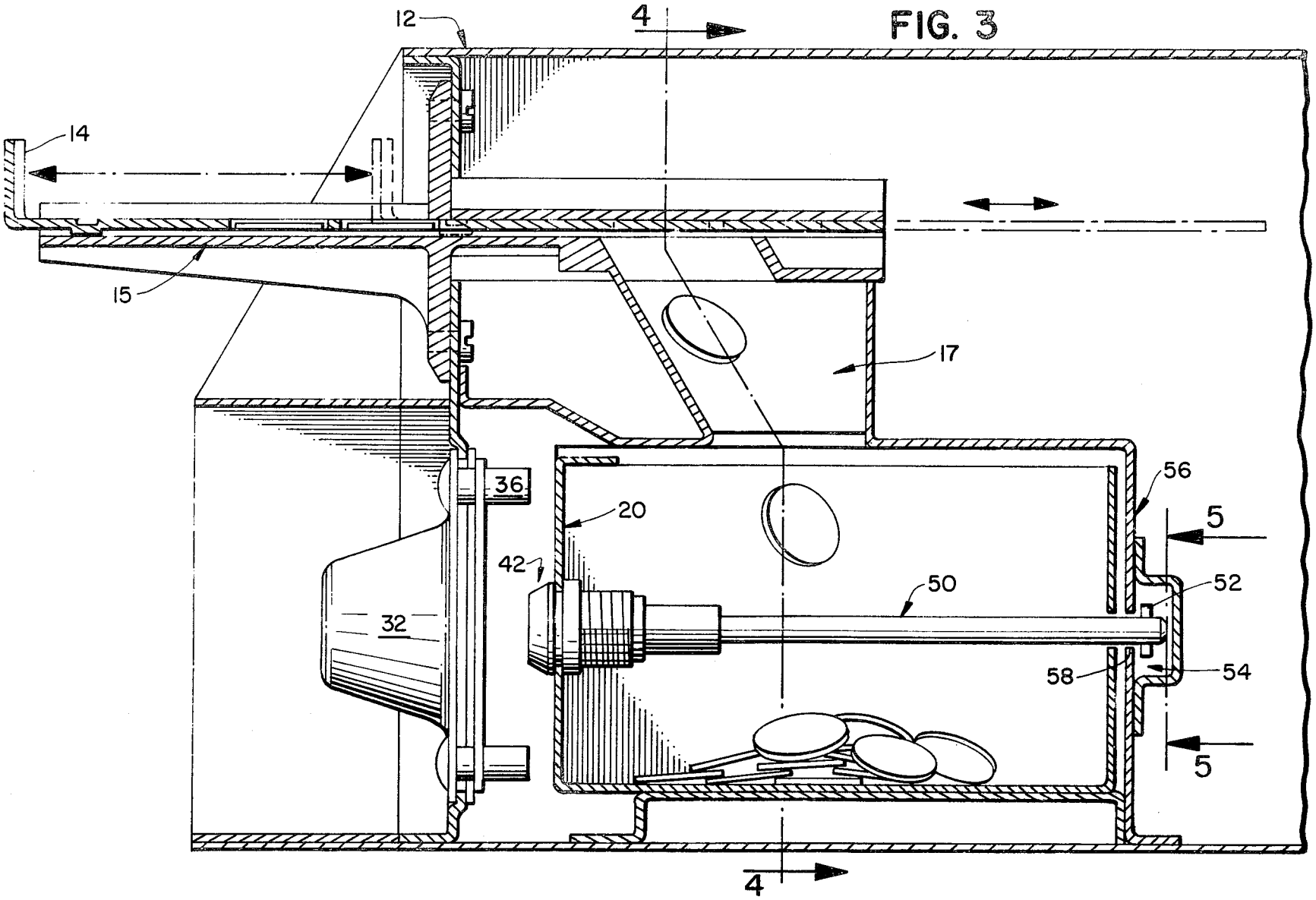
FIG. 3 is a vertical, longitudinal, sectional view through the coin diverter assembly.

Referring to FIGS. 1–3, the coin diverter of this invention is adapted to be used on a coin operated machine as is generally indicated at 10. The machine will generally inclulde a housing 12 attached to the outside of the machine for housing a coin inserting mechanism and coin receiving boxes. The housing 12 may be either permanently attached to the machine, such as by welding, or may be removably attached to the machine, by means of an appropriate locking device. However, the coin inserting mechanism and coin receiving boxes may be formed within the coin separated machine rather than mounted on the coin operated machine.

In the preferred embodiment the coin operated machine is activated by a coin slide 14. The coin slide 14 has coin slots 16 arranged on its topmost surface. The coins are retained in the coin slots in a manner which is well-known in the art by a plate 15 is underneath the slots which prevents the coins from falling through the slots.

As the coin slide is pushed into the housing and activates the machine, the coins in the coin slots fall through the slots and into one of the coin receiving boxes 18, 20. A passageway 17 may be used to connect the coin slots and the coin boxes, although this is not essential to the invention. The passageway 17 does not function to divide coins, which is accomplished automatically by the positioning of coin slots 16. The coin slots 16 are arranged in rows so that the coins in one row, 16A, are deposited in coin box 18, while the coins in the other row, 16B, are deposited in box 20.

The denomination and number of coin slots in each row of slots on the coin slide will determine the percentage allocation of the proceeds of the coin operated machine which are deposited into each coin receiving box. For example, as shown in FIG. 2, the coin slide comprises two equal rows of coin slots. Thus, an equal division of the proceeds will be effected.

Figure 6:
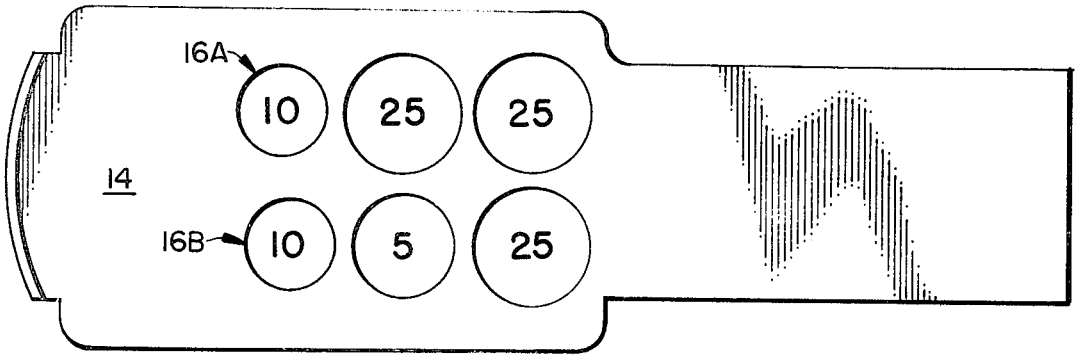
FIG. 6 is a top plan view of a modified coin slide.

As shown in FIG. 6, the coin slide comprises two rows of coin slots which will deposit 60 percent of the proceeds into one coin receiving box and 40 percent of the proceeds into the other coin receiving box.

Referring to FIGS. 2 and 3, the coin boxes are locked within the housing 12 by a general locking plate 30, which covers access to the individually and uniquely locked coin boxes 18 and 20. Locking plate 30 is locked by a lock mechanism 32 to which each of the parties to the proceed splitting agreement has a key. Lock plate 30 is releasably fixed in housing 12 by tabs 34 which are extended by lock mechanism 32 to engage a flange on the housing 12. Guide pins 36 facilitate positioning of locking plate 30.

Removal of locking plate 30 from the housing 12 permits access to coin boxes 18 and 20. Each of the coin boxes is separately and uniquely locked by its own locking mechanism—locking mechanism 40 locks box 18 and locking mechanism 42 locks box 20. Locking mechanism 40 cannot be unlocked by the key for locking mechanism 42 and vice versa. Each party to the agreement has the appropriate key which permits access only to the coin receiving his share of the proceeds.

Figure 4:
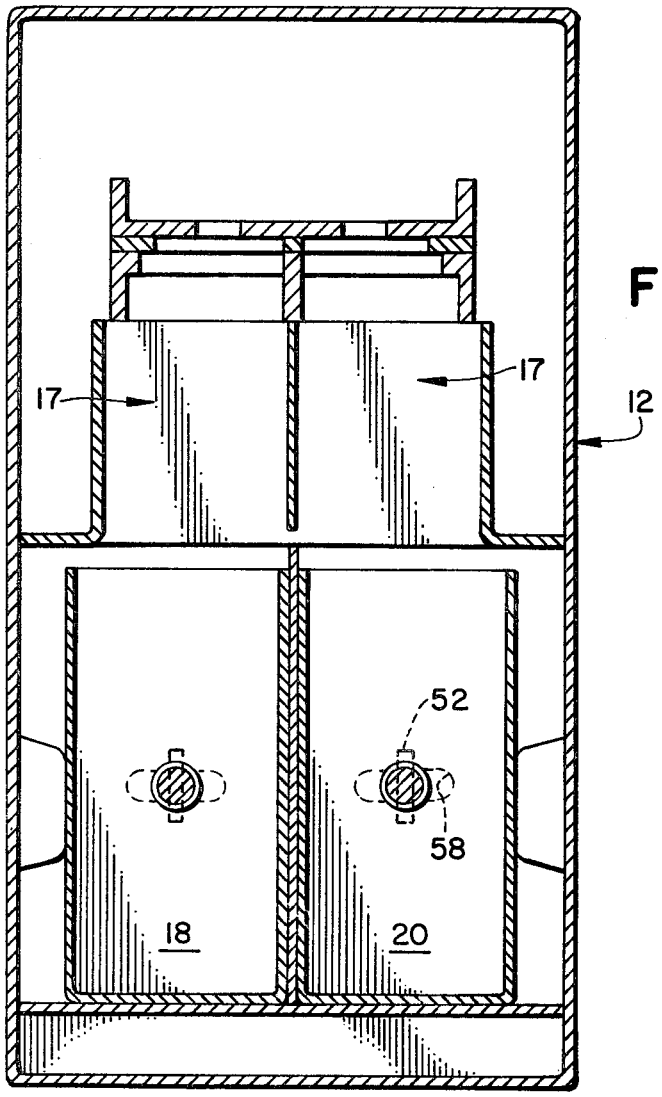
FIG. 4 is a sectional view taken along line 4—4 of FIG. 3.
Figure 5:
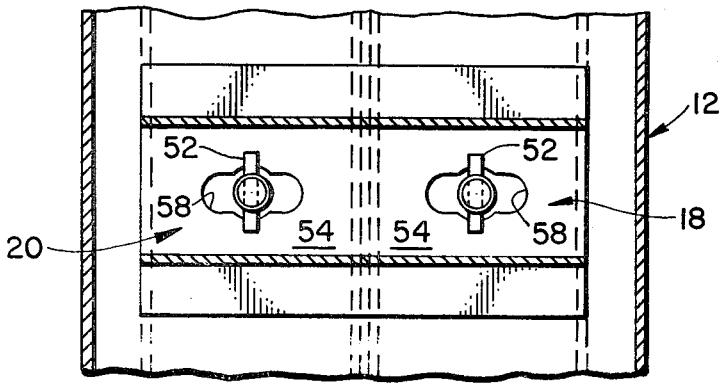
FIG. 5 is a sectional view taken along line 5—5 of FIG. 3.

The locking means may be any of the several types which are well-known throughout the industry. In the preferred embodiment (FIGS. 4 and 5), locking mechanisms 40 and 42 each comprise a rod 50 which can be rotated by the locking mechanism 40, 42. At the end of rod 50 is a locking bar 52 which fits in an opening 54 formed in the structure 56 in which lock boxes 18 and 20 are retained in housing 12. When locking bar 52 is in a vertical position, the coin box can not be removed from the housing. When locking bar 52 is in a horizontal position, it will fit through slot 58 formed in the structure 56 and the coin boxes may thus be removed from the housing 12 and access may be had to the contents of the coin box.

Thus, as described above each coin receiving box will automatically receive the agreed share which was allocated to that box. The person to whom that share will be provided has a key or other means for gaining access to that box. In order to revise the percentage allocation of proceeds it is only necessary to change the coin slide and coin activating mechanism within the machine.

While a preferred embodiment has been described it is to be understood that this invention includes all modifications which fall within the scope of the following claims.

I claim:

1. A coin diverter for coin operated machines comprising:

a housing;

a coin slide slidably positioned within said housing having a plurality of coin slots, for receiving coins, arranged in two rows to automatically divide the coins into two shares;

two coin receiving boxes, each of said boxes removably secured within said housing by an individual, unique locking mechanism;

said coin receiving boxes positioned below said coin slide within said housing so that when said coin slide is pushed into said housing the coins in one of said rows of coin slots are deposited into one of said coin receiving boxes and coins in the other of said rows of coin slots are deposited directed into the other of said coin receiving boxes.

2. A device for sorting coins comprising: a housing;

a coin slide slideable into said housing having at least two rows of coin slots for inserting coins into said housing;

at least two coin receiving boxes removably secured to said housing by separate and distinct locking mechanisms; and means operatively associated with said coin slide and said coin receiving boxes for diverting a specified share of coins from said coin slide into each of said coin receiving boxes.

3. The device of claim 2 wherein said means for directly diverting coins comprises the alignment of a coin receiving box directly below each of said rows of said coin slide so that when the slide is pushed into said housing the coins in each row of said slide are deposited directed into the coin receiving box below that row.

4. The device of claim 3 wherein there are two equal rows of coin slots positioned above two coin receiving boxes.

5. In combination, a coin slide with a plurality of coin slots for receiving coins;

at least two coin boxes for receiving coins from said coin slots, each of said coin boxes having an individual and unique locking mechanism;

said coin slots arranged in at least two rows so that when said coin slide is actuated, coins from each of said rows are deposited into a designated one of said boxes, said coin slide automatically diverting a specified share of coins inserted into said coin slide into each of said coin boxes.

6. The combination claimed in claim 5, wherein the coin slots are arranged in a particular pattern to effect the specified division of coins.

7. The combination claimed in claim 5, wherein said locking mechanism locks each of said coin boxes to a coin operated machine.

* * * * *